US011302296B2

(12) United States Patent
Kafuku et al.

(10) Patent No.: US 11,302,296 B2
(45) Date of Patent: Apr. 12, 2022

(54) METHOD IMPLEMENTED BY PROCESSOR, ELECTRONIC DEVICE, AND PERFORMANCE DATA DISPLAY SYSTEM

(71) Applicant: CASIO COMPUTER CO., LTD., Tokyo (JP)

(72) Inventors: Shigeru Kafuku, Akishima (JP); Hiroko Okuda, Kokubunji (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/798,232

(22) Filed: Feb. 21, 2020

(65) Prior Publication Data

US 2020/0286454 A1 Sep. 10, 2020

(30) Foreign Application Priority Data

Mar. 8, 2019 (JP) ..... JP2019-043126

(51) Int. Cl.
*G10H 1/38* (2006.01)
*G10H 1/00* (2006.01)
*G10H 1/34* (2006.01)

(52) U.S. Cl.
CPC ..... *G10H 1/0008* (2013.01); *G10H 1/34* (2013.01); *G10H 2210/066* (2013.01); *G10H 2210/081* (2013.01); *G10H 2210/571* (2013.01); *G10H 2220/091* (2013.01); *G10H 2220/221* (2013.01)

(58) Field of Classification Search
CPC ..... G10H 1/00; G10H 1/38; G10H 2210/066; G10H 2210/081; G10H 2210/576; G10H 1/383; G10H 1/368; G10H 2220/101; G10H 2210/616
See application file for complete search history.

(56) References Cited

U.S. PATENT DOCUMENTS 6,225,545 B1 * 5/2001 Suzuki ..... G09B 15/023 84/464 R
6,898,759 B1 5/2005 Terada et al.
8,314,320 B2 11/2012 Okuda
9,583,084 B1 * 2/2017 Fagan ..... G10H 1/38
10,269,335 B1 * 4/2019 O'Hair ..... G10H 1/386
2011/0185881 A1 8/2011 Okuda
2011/0203445 A1 * 8/2011 Stanger Ramirez ..... G10H 1/0066 84/645

(Continued)

FOREIGN PATENT DOCUMENTS

JP 3211839 B2 3/1991
JP 2581370 B2 12/1991

(Continued)

OTHER PUBLICATIONS

Japanese Office Action (and English language translation thereof) dated Jul. 13, 2021 issued in counterpart Japanese Application No. 2019-043126.

*Primary Examiner* — Marlon T Fletcher
(74) *Attorney, Agent, or Firm* — Holtz, Holtz & Volek PC

(57) ABSTRACT

A method implemented by a processor includes
receiving performance data including pitch data;
determining, based on the pitch data that is included in the received performance data, a key among a plurality of keys;
selecting, based on the determined key and the pitch data, a first-type image from among a plurality of first-type images; and
displaying the selected first-type image.

10 Claims, 11 Drawing Sheets

(56) References Cited

U.S. PATENT DOCUMENTS

| | | | | |
|---|---|---|---|---|
| 2012/0160079 | A1* | 6/2012 | Little | G10H 1/0066 84/613 |
| 2018/0342228 | A1* | 11/2018 | Wei | G10H 1/0016 |
| 2019/0164529 | A1* | 5/2019 | Kafuku | G10H 1/383 |
| 2019/0348015 | A1* | 11/2019 | Kubita | G10H 1/0016 |
| 2020/0111467 | A1* | 4/2020 | Hofuku | G10H 1/0008 |
| 2020/0286454 | A1* | 9/2020 | Kafuku | G10H 1/368 |

FOREIGN PATENT DOCUMENTS

| | | | |
|---|---|---|---|
| JP | H11224084 | A | 8/1999 |
| JP | 2003099056 | A | 4/2003 |
| JP | 2009025648 | A | 2/2009 |
| JP | 2011158855 | A | 8/2011 |

* cited by examiner

METHOD IMPLEMENTED BY PROCESSOR, ELECTRONIC DEVICE, AND PERFORMANCE DATA DISPLAY SYSTEM

CROSS-REFERENCE TO RELATED APPLICATION

This application claims the benefit of Japanese Patent Application No. 2019-043126, filed on Mar. 8, 2019, the entire disclosure of which is incorporated by reference herein.

FIELD

This application relates generally to a method implemented by processor, an electronic device, and a performance data display system.

BACKGROUND

Unexamined Japanese Patent Application Kokai Publication No. H11-224084 discloses a system for moving an image object such as a dancer in synchronization with a performance, but a character representing the dancer is merely caused to dynamically appear during the performance.

SUMMARY

In a first aspect of the present disclosure, a method implemented by a processor includes:

receiving performance data including pitch data (note number information);

determining, based on the pitch data that is included in the received performance data, a key among a plurality of keys including a major key or a minor key;

selecting, based on the determined key and the pitch data, a first-type image (flower) from among a plurality of first-type images; and displaying the selected first-type image.

In a second aspect of the present disclosure, an electronic device includes:

a display device; and a processor, wherein the processor receives performance data including pitch data, determines, based on the pitch data that is included in the received performance data, a key among a plurality of keys including a major key or a minor key, selects, based on the determined key and the pitch data, a first-type image from among a plurality of first-type images; and displays the selected first-type image.

In a third aspect of the present disclosure, a performance data display system includes:

an electronic musical instrument; and a display device, wherein the electronic musical instrument generates performance data including pitch data in accordance with a performance operation by a user, and outputs the generated performance data to the display device, and the display device receives the performance data, determines, based on the pitch data that is included in the received performance data, a key among a plurality of keys including a major key or a minor key, selects, based on the determined key and the pitch data, a first-type image from among a plurality of first-type images, and displays the selected first-type image.

BRIEF DESCRIPTION OF THE DRAWINGS

A more complete understanding of this application can be obtained when the following detailed description is considered in conjunction with the following drawings, in which.

DETAILED DESCRIPTION

An information processing device according to an embodiment for implementing the present disclosure is described below with reference to drawings.

Figure 1:
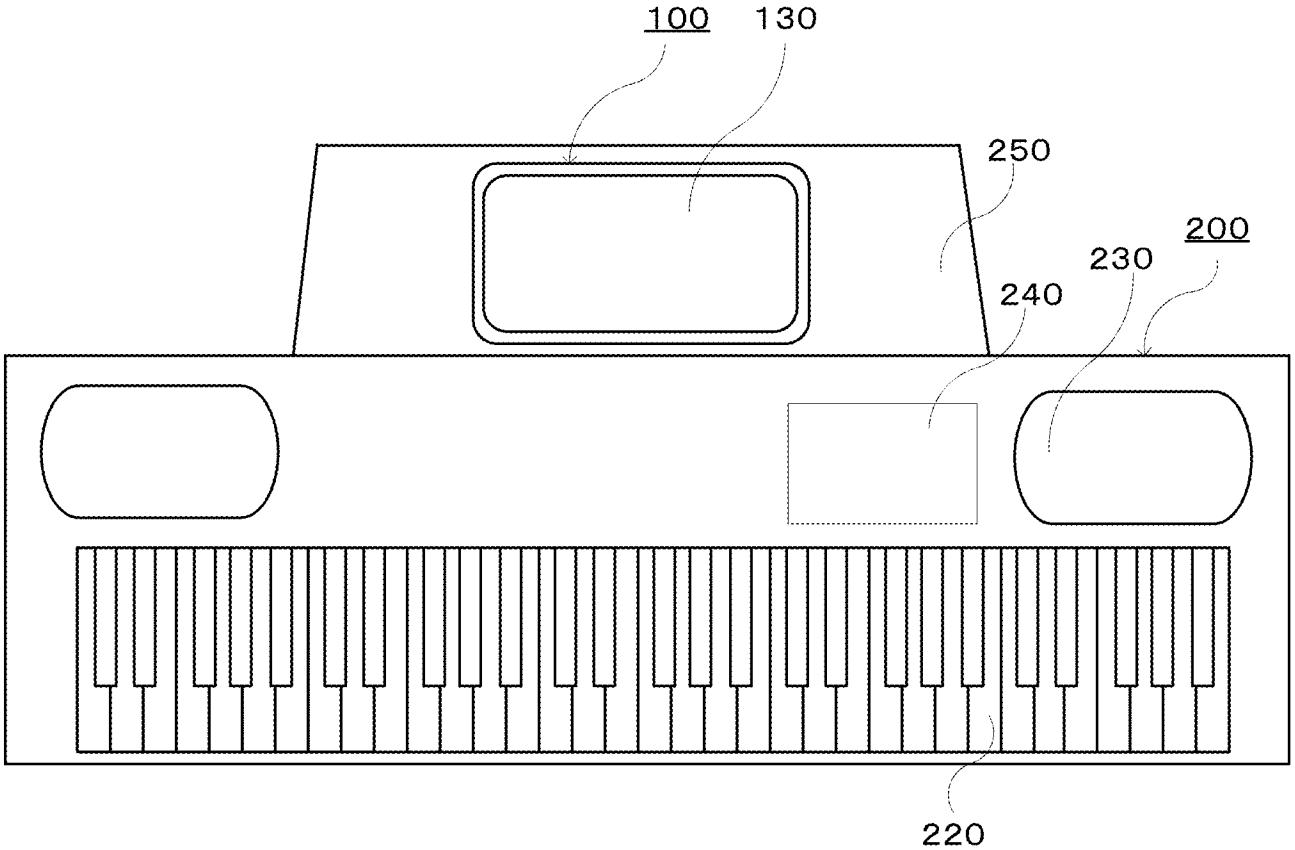
FIG. 1 is a diagram illustrating an information processing device and an electronic musical instrument according to an embodiment of the present disclosure.

An information processing device 100 according the embodiment of the present disclosure, as illustrated in FIG. 1, becomes operational when connected to an electronic musical instrument 200 via a wired line or a wireless link. The electronic musical instrument 200 includes an electronic keyboard musical instrument such as an electronic piano, a synthesizer, an electronic organ, or the like, piano keys (performance operation elements) 220, an audio speaker 230, an operation unit 240, and a sheet-music stand 250. The information processing device (slave device) 100 includes a display device, a tablet personal computer (PC), or a smartphone and the information processing device 100 is mounted on the sheet-music stand 250. The information processing device 100 equipped with a display 130 displays an image that visually expresses a musical composition performed using the electronic musical instrument 200 in real-time or after the performance. The information processing device 100 and the electronic musical instrument 200 together make up an electronic musical instrument system (performance data display system).

Figure 2:
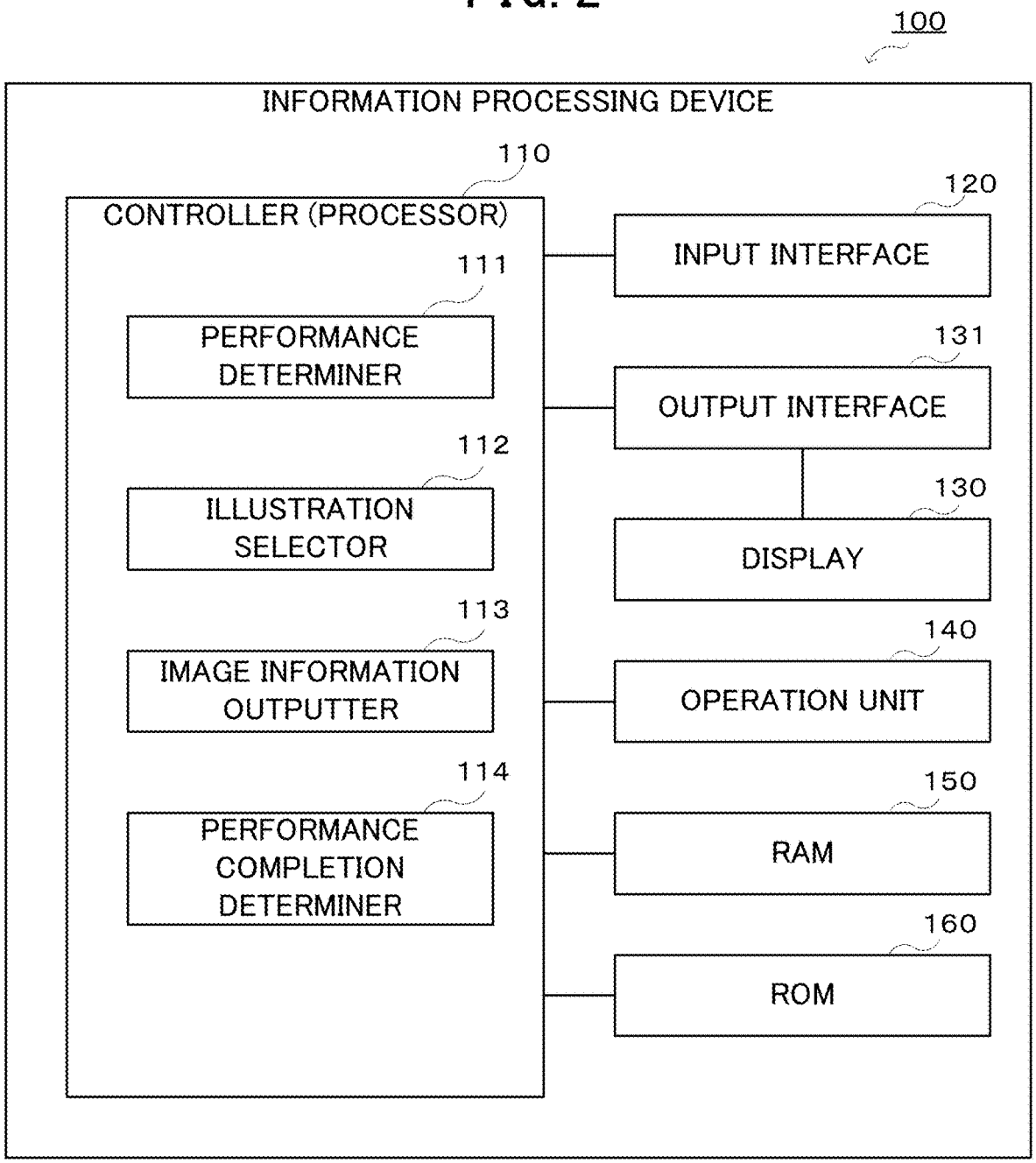
FIG. 2 is a schematic block diagram illustrating a configuration example of the information processing device according to the embodiment of the present disclosure.

The information processing device 100, as illustrated in FIG. 2, includes a controller (processor) 110, an input interface 120, a display 130, an operation unit 140, a random access memory (RAM) 150, and a read-only memory (ROM) 160.

The controller 110 includes a central processing unit (CPU). The controller 110 performs overall control of the information processing device 100 by reading a program and data stored in the ROM 160 and using the RAM 150 as a working area.

The input interface 120 receives inputs of performance data containing pitch information indicating pitches sent from the electronic musical instrument 200 and stores the performance data into the RAM 150. As an example, the performance data containing pitch data includes data structures that are compliant with the Musical Instrument Digital Interface (MIDI). The input interface 120 includes an interface that is compliant with the MIDI standard and the interface includes a wireless unit or a wired unit for communicating with an external device.

The display 130 includes a display panel such as a liquid crystal display (LCD) panel, an organic electroluminescent (EL) panel, a light emitting diode (LED) panel, or the like and a display controller. The display 130 displays images in accordance with control signals outputted from the controller 110 via an output interface 131. In the present embodiment, the image that visually expresses the musical composition performed using the electronic musical instrument 200 is displayed in real-time or after the performance.

Examples of output devices the operation unit 140 is equipped with include a keyboard, a mouse, a touch panel, a button, and the like. The operation unit 140 receives input operations from a user and outputs input signals representing the operation details to the controller 110. The operation unit 140 and the display 130 may be configured to overlap each other in a touch panel display.

The RAM 150 includes volatile memory and is used as a working area for execution of programs for the controller 110 to perform various types of processing. The RAM 150 stores the performance data containing the pitch data sent from the electronic musical instrument 200.

The ROM 160 is non-volatile semiconductor memory such as flash memory, erasable programmable read-only memory (EPROM), or electrically erasable programmable rom (EEPROM) and assumes the role of a so-called secondary storage device or auxiliary storage device. The ROM 160 stores programs and data used by the controller 110 for performing various types of processing, and also stores data generated or acquired by the controller 110 for performing various types of processing. In the present embodiment, the ROM 160 stores, for example, an illustration table in which the performance data (for example, pitch data, chord functions in each key, chord data, and the like) in association with illustrations.

Next, the functional configuration of the controller 110 of the information processing device 100 according to the embodiment is described. The controller 110 functions as a performance determiner 111, an illustration selector 112, an image information outputter 113, and a performance completion determiner 114 by the CPU reading and executing the programs and data stored in the ROM 160.

The performance determiner 111 determines tonality (for example 24 types from C major to B minor), pitch names (do, re, and mi, for example), chord types (Major, Minor, Sus4, Aug, Dim, 7th, and the like), velocity values, note lengths, chord functions, and chord progressions of a musical composition based on performance data received via an input interface. Also, the performance determiner 111 determines the tonic (first degree) from the tonality of the musical composition and then determines the n-th degree (interval) (n being an integer from 1 to 7) of the tonic in the tonality of the musical composition. Also, the performance determiner 111 evaluates the performance based on the timings at which each of the piano keys 220 is operated by the user and scores the performance based on, for example, the velocity values. Also, the scoring result is not based on a relative scoring scheme for comparing the performance against data pre-stored in the memory indicating what is correct, but rather the performance is scored based on an absolute scoring scheme for performing evaluation with only the performance data included in each segment determined in a real-time performance. The velocity value is determined by the keypress velocity of the piano key 220. The pitch name is determined by the note number or the like included in the performance data. For example, scoring is based on whether or not the timing at which the performance operation elements are operated constitutes steady rhythmical timing, and the memory has no correct data stored therein for determining whether the received performance data is correct or not. The controller does not know what musical composition the user is performing. Even if the user is performing a musical improvisation, the controller assigns a score to the performance result in accordance with the received performance data.

Specifically, the performance determiner 111 receives, in accordance with the user operations directed at the piano keys 220 each corresponding to a pitch among pitches including a particular pitch, inputs of multiple performance data each of which include multiple pitch data, and the performance determiner 111 determines the chord based on the tonality of the musical composition determined based on the multiple pitch data received, even when there is no chord specified by the user. In a case where a melody is received with operation of the piano keys 220 by the user at different timings, the tonality of the musical composition is determined based on the multiple pitch data received by the performance of the melody by user even if an accompaniment containing chord types is not performed by the user. For example, in a case where C (do)-D (re)-E (mi)-F (fa)-B (ti) are to be inputted as the melody, when the pitch of C is inputted as the first sound, C is set as the temporary key even though seven types exist as candidates of. When D and E are further inputted, the key is limited to C, G, and F. When F is inputted, the key is limited to C and F and when B is further inputted, a determination is made that the key is C, and thus a determination is made that the tonality of the musical composition is C major. The chord function (degree)

is determined based on the tonality and the music notes of the musical composition. Specifically, the determination of the tonality of the musical composition based on the chords is disclosed in, for example, Japanese Patent No. 2581370 and the determination of the tonality of the musical composition based on the melody is disclosed in, for example, Unexamined Japanese Patent Application Kokai Publication No. 2011-158855. Also, in a case where the multiple pitch data referring to chords for which the timing of the operations at which the piano keys 220 are operated by the user fall within a particular time period are received, the pitch name indicating the highest pitch and the chord type are determined based on the multiple pitch data. The multiple pitch data includes operations in which the user intentionally operated multiple piano keys 220 at the same time yet excludes operations in which the user intentionally operated multiple piano keys 220 at different timings. In such a case, although not limiting, the method disclosed in, for example, Japanese Patent No. 3211839 the determination method for determining the chord functions can be used as the determination method of determining the chord functions.

Each time performance data is received, the illustration selector 112 selects, based on the n-th degree determined from the tonality and the pitch name of the musical composition determined by the performance determiner 111, a type of the first illustration (image of a first type equivalent to a type of a particular flower in an example of an embodiment) that is a component included in the image to be displayed, from within a first illustration group (illustration group with different types of flowers in the present embodiment). In a case where the operation for performing a chord is received, the illustration selector 112 selects a type of the first illustration based on the n-th degree (interval) determined from the tonality and pitch name indicating the highest pitch among the multiple pitch data of the musical composition. Also, the illustration selector 112 selects, based on the chord type (or the chord function), the type of the second illustration (a type of a particular plant=image of a second type)) from within the second illustration group (illustration group with different types of plants in the present embodiment). The illustration selector 112 selects the size at which the first and second illustrations are to be displayed on the display 130 based on the velocity values included in the performance data. The illustration selector 112 also performs image processing on at least one of the first or the second illustrations in accordance with the evaluation result obtained from evaluating the performance. The illustration selector 112 also colors at least one of the first or the second illustrations in accordance with the scoring result. The illustration selector 112 also selects, based on the chord progression, the trajectory pattern PS in which the first and second illustrations are placed in the display image.

Figure 3A:
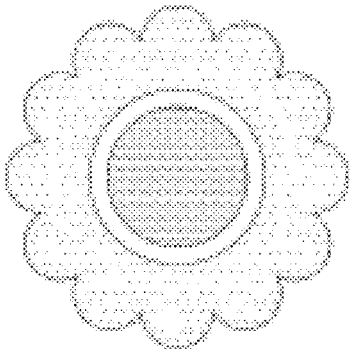
FIG. 3A, FIG. 3B, and FIG. 3C are diagrams illustrating images (hereinafter referred to as the first illustration) of a first type of "flower" according to the embodiment of the present disclosure.
Figure 3B:
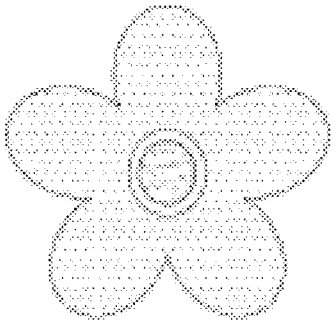
Figure 3C:
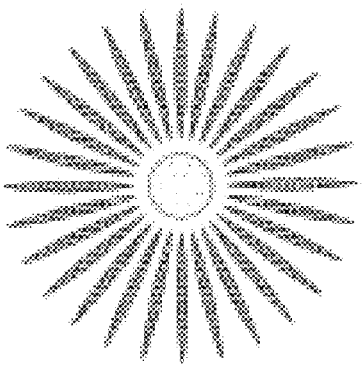

Specifically, the illustration selector 112 selects, based on the tonality and the pitch name of the piece of music as determined by the performance determiner 111, a type of the first image (type of a particular flower) from a first illustration group including twelve types of images of flowers stored in advance in the ROM 160. The examples illustrated in FIG. 3A, FIG. 3B, and FIG. 3C indicate three images of flowers that are included in the first illustration group. Specifically, the type of the first illustration corresponding to the n-th degree (interval) determined by the performance determiner 111 is selected. For example, in a case where the pitch of D (re) is inputted when the tonality of the musical composition is C, a determination is made that the inputted pitch is the second degree, and thus the first illustration illustrated in FIG. 3A is selected. If F (fa) is inputted when the tonality of the musical composition is Eb, a determination is made that the inputted pitch is the second degree, and likewise, the first illustration illustrated in FIG. 3A is selected. By doing so, it can be indicated whether the inputted pitch is inputted in n-th degree in a particular tonality, and a user can intuitively understand whether the inputted pitch is the n-th degree even when the key changes.

Figure 4A:
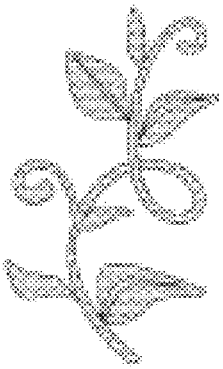
FIG. 4A, FIG. 4B, and FIG. 4C are diagrams illustrating images (hereinafter referred to as the second illustration) of a second type of "plant" according to the embodiment of the present disclosure.
Figure 4B:
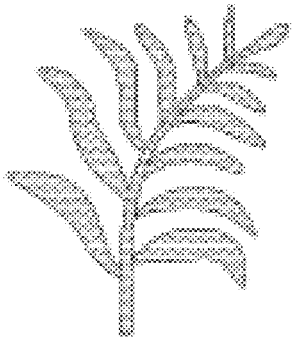
Figure 4C:
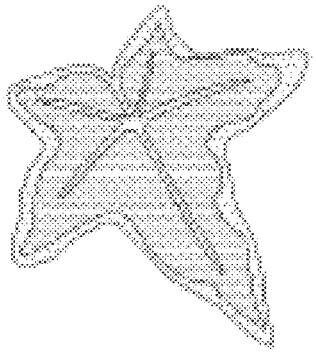
Figure 5A:
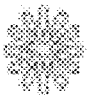
FIG. 5A, FIG. 5B, and FIG. 5C are diagrams illustrating variations in size of the first illustration according to the embodiment of the present disclosure.
Figure 5B:
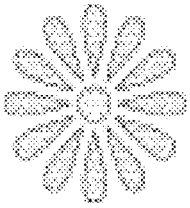
Figure 5C:
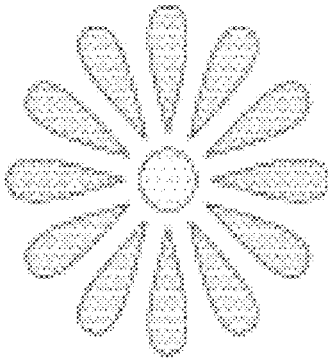
Figure 6A:
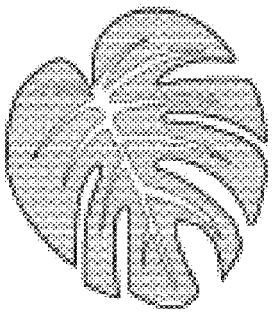
FIG. 6A, FIG. 6B, and FIG. 6C are diagrams illustrating modified states of the second illustration according to the embodiment of the present disclosure.
Figure 6B:
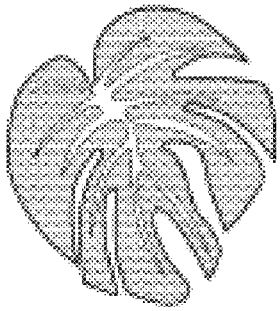
Figure 6C:
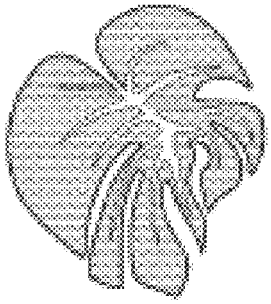
Figure 7A:
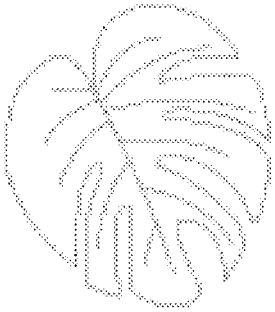
FIG. 7A, FIG. 7B, and FIG. 7C are diagrams illustrating colorations of the second illustration according to the embodiment of the present disclosure.
Figure 7B:
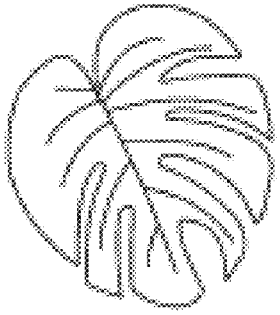
Figure 7C:
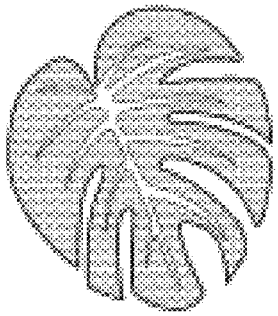
Figure 8A:
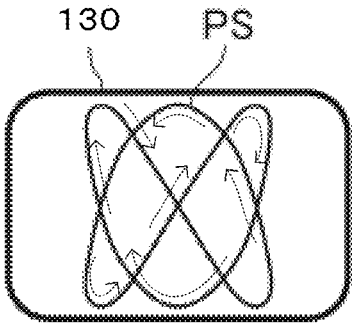
FIG. 8A, FIG. 8B, and FIG. 8C are diagrams illustrating trajectory patterns illustrating the first and the second illustrations according to the embodiment of the present disclosure.
Figure 8B:
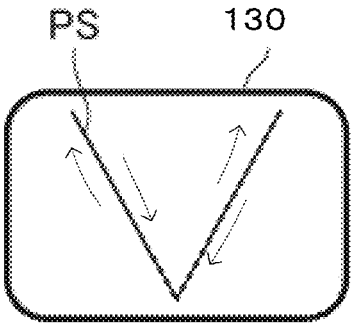
Figure 8C:
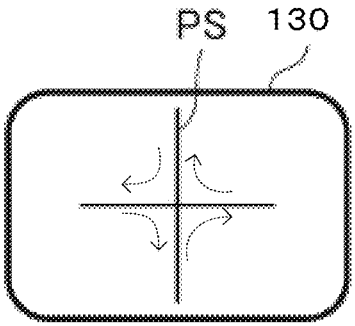

The illustration selector 112 selects, from among the second illustration group including ten types of images of plants stored in advance in the ROM 160, the type of second illustration corresponding to the chord type determined by the performance determiner 111. The examples illustrated in FIG. 4A, FIG. 4B, and FIG. 4C indicate three images of plants included in the second illustration group. As illustrated in FIG. 5A, FIG. 5B, and FIG. 5C, the illustration selector 112 also selects the size of the first and the second illustrations in accordance with, for example, the velocity values determined by the performance determiner 111. In a case where the velocity value is small (the keypress velocity of the piano key 220 is slow and the volume is low), the small first illustration illustrated in FIG. 5A is selected, whereas in a case where the velocity value is large (the keypress velocity of the piano key 220 is fast and the volume is high) the large first illustration illustrated in FIG. 5C is selected. Likewise, the type of the second illustration is selected in accordance with the chord type. That is, the size of the first illustration (flower) and the size of the second illustration (plant) that is displayed on the display 130 may be enlarged or reduced in size in accordance with the velocity value. The illustration selector 112 also performs image processing, as illustrated in FIG. 6A, FIG. 6B, and FIG. 6C, on the first and second illustrations in accordance with the evaluation result obtained from the evaluation performed by the performance determiner 111. In a case where a score indicating the evaluation result is lower than a particular score serving as a standard, the illustration selector 112 executes image processing causing the shape of the image of the plant to become deformed as an illustration, as illustrated in FIG. 6C. Also, in a case where the scoring result obtained from the scoring performed by the performance determiner 111 does not reach a particular standard, the second illustration is changed to a line drawing in which the area within the outline is uncolored, for example, as illustrated in FIG. 7A or FIG. 7B, whereas when the scoring result reaches the particular standard a second illustration whose area within the outline is colored is selected as illustrated in FIG. 7C. Also, the illustration selector 112, as illustrated in FIG. 8A, FIG. 8B, and FIG. 8C, selects a trajectory pattern PS corresponding to the chord progression from among 14 types of trajectory patterns stored in advance in the ROM 160 and determines the positions where the first and the second illustrations are placed in the display image in accordance with the selected trajectory pattern PS. For example, FIG. 8A illustrates the cord progression of Canon, FIG. 8B illustrates the chord progression of a western musical composition, and FIG. 8C illustrates a J-POP chord progression. Each of the illustrations is placed such that at least a portion of each illustration overlaps with an imaginary line along the trajectory pattern PS. That is, the first illustration determined in accordance with a first piano key pressing indicating a first user operation and the second illustration determined in accordance with a second piano key pressing indicating a second user operation following the first user operation are not places in the same position in the image, but rather are placed at different positions on the imaginary line indicated by the trajectory pattern PS.

The image information outputter 113 generates an image in which the first and second illustrations determined by the illustration selector 112 are placed in accordance with the selected trajectory pattern PS and outputs the generated image from the output interface 131 in real-time in accordance with the performance. In a case where a determination by the performance completion determiner 114 that is made that the performance is completed, the image information outputter 113 reconfigure placement positions of the first and second illustrations and displays a second image including the reconfigured first and second illustrations.

The performance completion determiner 114 makes a determination as to whether the performance is completed based on whether an input of the performance data was not received within a particular time period or whether information indicating that the performance is completed was received via the input interface.

Figure 9:
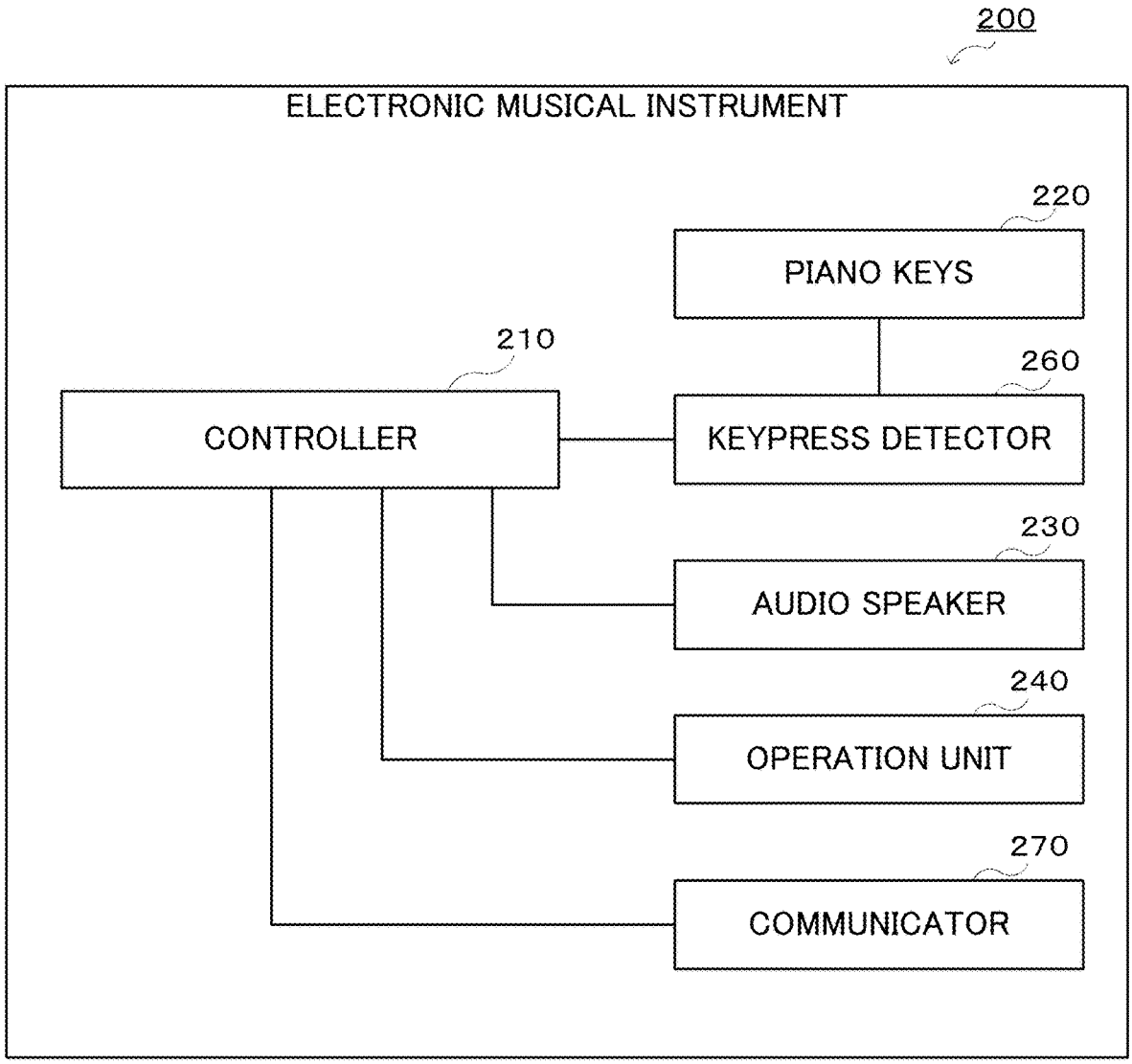
FIG. 9 is a schematic block diagram illustrating a configuration example of the electronic musical instrument according to the embodiment of the present disclosure.

The electronic musical instrument 200 includes a controller 210, a keypress detector 260, and a communicator 270 as the electrical components in addition to the aforementioned piano keys 220, the audio speaker 230, the operation unit 240, and the sheet-music stand 250, as illustrated in FIG. 9.

The controller 210 includes, for example, the CPU, the ROM, and the RAM and is the portion that controls the electronic musical instrument 200 by reading the programs and data stored in the ROM and by using the RAM as the working area. The controller 210 performs operations including controlling the audio speaker 230 to produce sounds in accordance with the pressing of the piano keys 220 and controlling the muting of music produced by the audio speaker 230 in accordance with the releasing of the piano keys 220. The controller 210 also transmits the performance data containing the pitch data to the information processing device 100 via the communicator 270.

The piano keys 220 are performance operation elements that the piano player uses to specify the pitch. The pressing and releasing of the piano keys 220 by the piano player causes the electronic musical instrument 200 to produce or mute sounds corresponding to the specified pitch.

The audio speaker 230 is the portion that outputs sounds of the musical composition performed by the piano player. The audio speaker 230 converts audio signals outputted by the controller 210 into sounds and outputs the sounds.

The operation unit 240 includes operation buttons that is used by the piano player to perform various settings and is the portion that is used for performing various setting operations such as volume adjustment and the like. The operation unit 240 may be displayed on the touch panel display.

The keypress detector 260 detects key releasing, the key pressing, and the keypress velocity of the piano keys 220. The keypress detector 260 is the portion that outputs the performance data containing the detected pitch information to the controller 210. The keypress detector 260 is provided with a switch located beneath the piano key 220 and this switch detects the key releasing, the key pressing, and the keypress velocity.

The communicator 270 is equipped with a wireless unit or a wired unit for performing communication with external devices. In the present embodiment, the communicator 270 includes an interface that is compliant with the MIDI standard and transmits the performance data containing the pitch data to the information processing device 100, based on the control by the controller 210. The performance data is, for example, data having a data structure that is compliant with the MIDI standard.

Next, the image display processing that is executed by the information processing device 100 which includes the aforementioned configuration is described.

Figure 10:
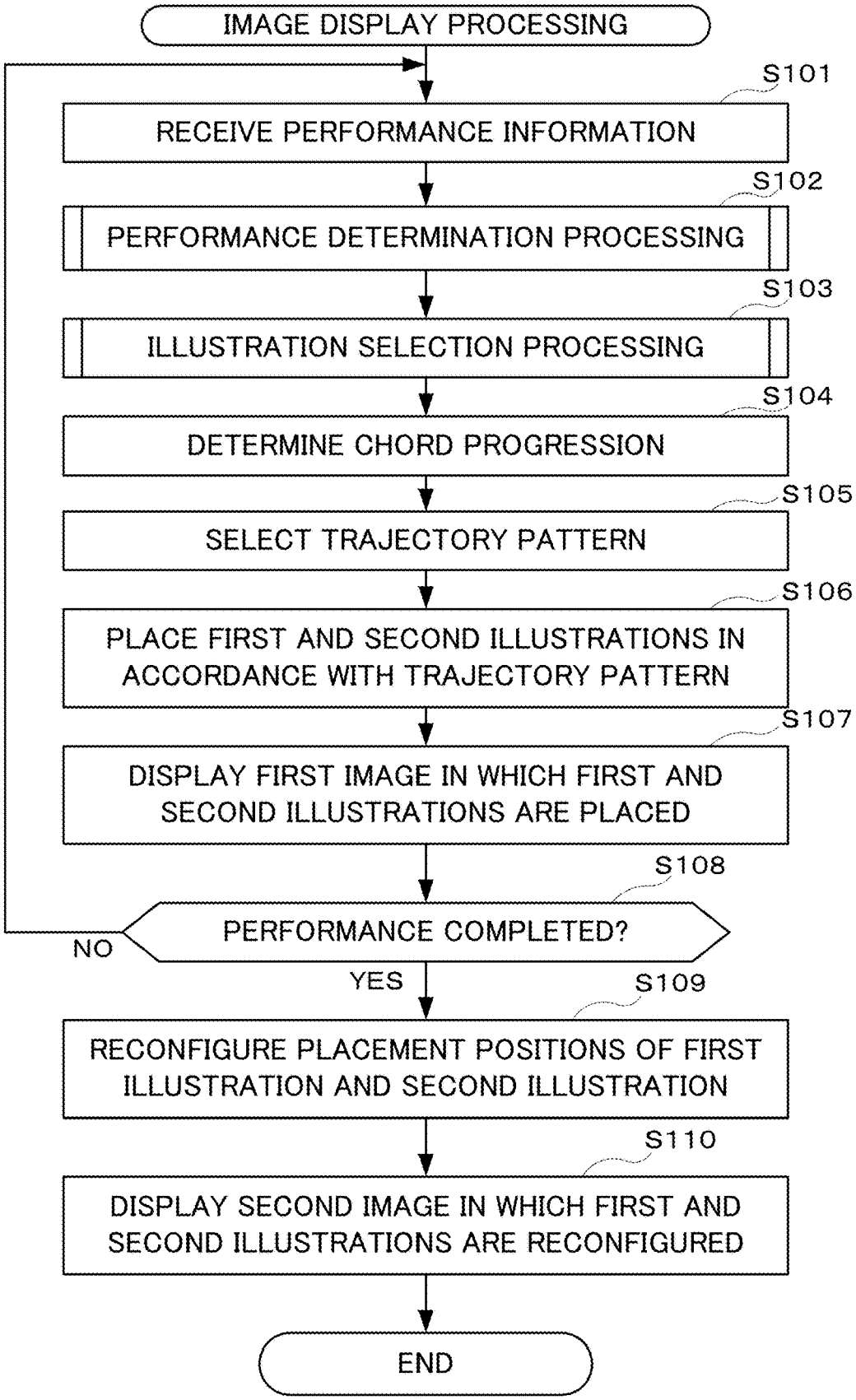
FIG. 10 is a flowchart illustrating image display processing according to the embodiment of the present disclosure.

Upon receiving via the operation unit 140 the operation input indicating the start of the present processing, for example, the controller 110 starts image display processing illustrated in FIG. 10.

Figure 11:
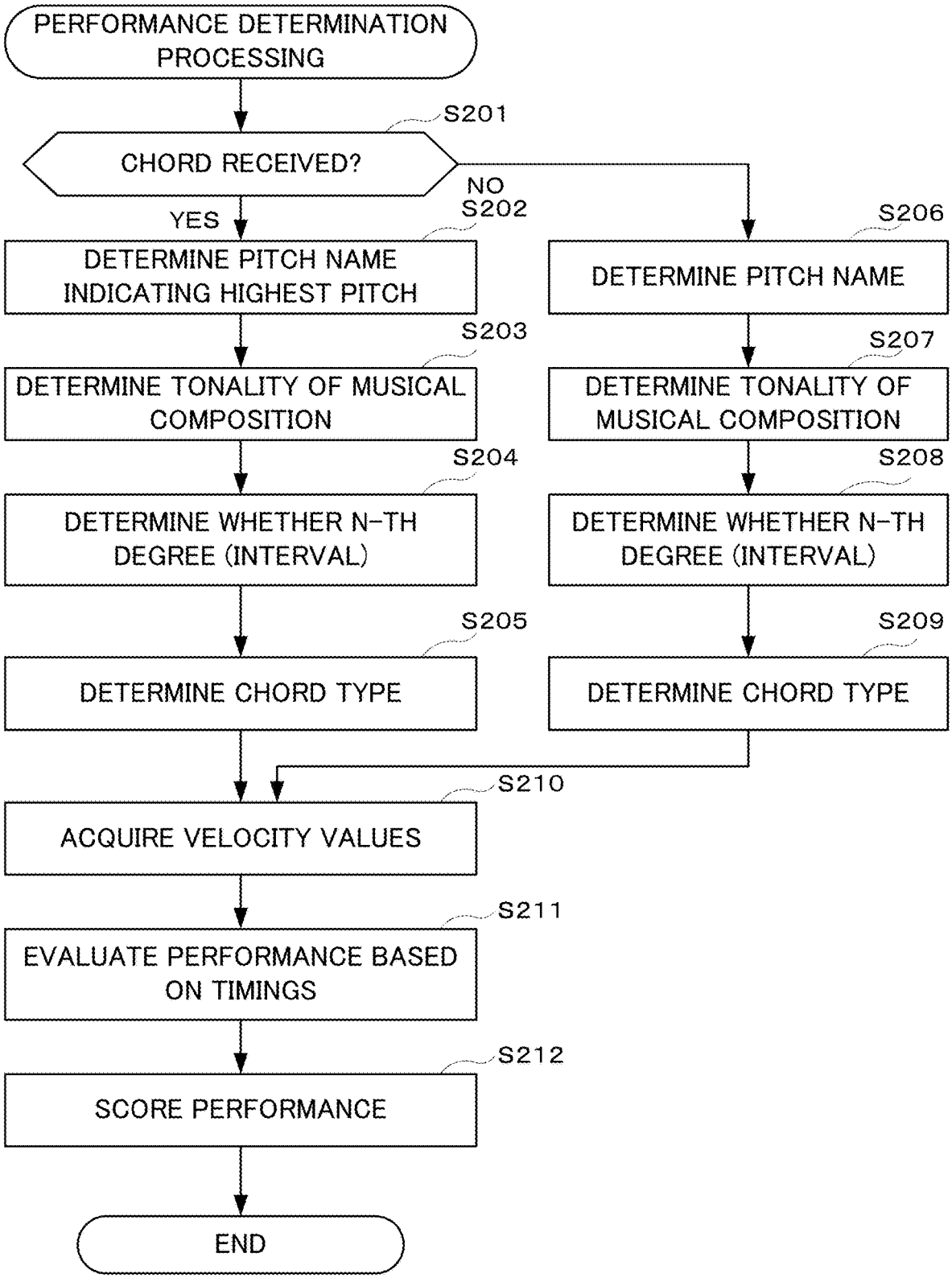
FIG. 11 is a flowchart illustrating performance determination processing according to the embodiment of the present disclosure.

The performance determiner 111 receives via the input interface 120 the performance data containing the pitch data outputted from the electronic musical instrument 200 on which the user performed (step S101). Next, the performance determiner 111 executes performance determination processing illustrated in FIG. 11 (step S102).

When performance determination processing beings, the performance determiner 111 makes a determination as to whether or not a chord is received (step S201). If the timing of the operation of the piano keys 220 by the user is performed within a particular time period, a determination is made that a chord is received. If the timings of the operations of the piano keys 220 by the user are performed are different, a determination is made that a chord is not received (a melody is inputted). If a determination is made that a chord is received (YES in step S201), the performance determiner 111 determines the pitch name of the highest pitch based on the multiple pitch data included in the received multiple performance data (step S202). Next, the performance determiner 111 determines the tonality of the musical composition (step S203). The performance determiner 111 determines the tonic (first degree) of the musical composition, and then determines whether the determined pitch name indicating the highest pitch is the n-th degree in the tonality of the musical composition (step S204). For example, in a case where the pitch of D (re) is inputted as the pitch name indicating the highest pitch when the tonality of the music composition is C, a determination is made that the inputted pitch is the second degree, and in a case where the pitch of F (fa) is inputted when the tonality of the musical composition is Eb, a determination is made that the inputted pitch likewise is the second degree. Next, the performance determiner 111 determines the chord based on the multiple pitch data included in the multiple performance data (step S205).

If a determination is made that a chord is not received (a melody is received) (NO in step S201), the performance determiner 111 determines the pitch name indicated the received pitch data (step S206). Next, the performance determiner 111 determines the tonality of the musical composition based on the multiple pitch data included in the received multiple performance data received through the performance of the melody by the user (step S207). When the first sound is inputted, that sound is set as the temporary key. Each time a subsequent sound is inputted, the subsequent sound limits the candidates of the key and when one candidate of the key remains, that candidate is determined to be the key. The tonality of the musical composition is determined based on this key. The performance determiner 111 determines the tonic (first degree) from the tonality of the musical composition and then determines whether the determined pitch name is the n-th degree in the tonality of the musical composition (step S208). Next, the performance determiner 111 determines the chord type in a particular chord section (chord section) based on (i) the multiple pitch data included in the multiple performance data received through the performance of the melody by the user and (ii) beat information determined based on the rhythm determined by the controller 110 from the information indicating the timings at which the multiple performance data is received (step S209).

Figure 12:
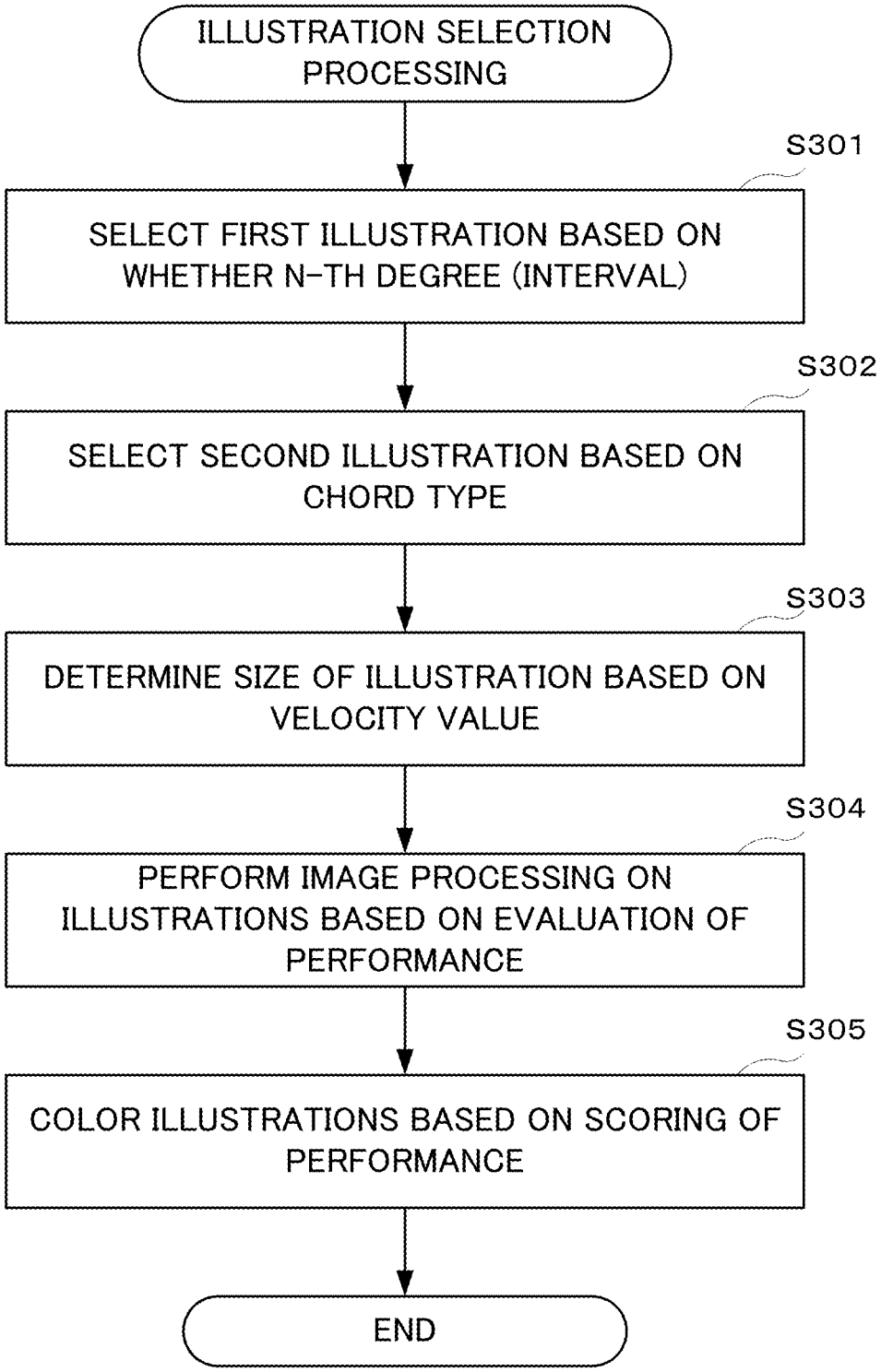
FIG. 12 is a flowchart illustrating illustration selection processing according to the embodiment of the present disclosure.

Next, the performance determiner 111 acquires velocity values included in the performance data (step S210). The performance determiner 111 then evaluates the performance based on the timings at which the piano keys 220 were operated by the user (step S211). The performance determiner 111 then scores the performance based on the velocity values (step S212). If the velocity values have a high degree of regularity (for example, there is almost no difference and inconsistency between each velocity value and an average value calculated based each of the velocity values) a high-scoring result is received whereas if the velocity values have a low degree of regularity (for example, there is a great difference and inconsistency between each velocity value and the average value calculated based each of the velocity values) a low scoring result is received. After this, the performance determination processing is completed so processing returns to the image display processing illustrated in FIG. 10. Next, the illustration selector 112 executes the illustration selection processing illustrated in FIG. 12 (step S103).

When the illustration selection processing starts, the illustration selector 112 selects a type of the first illustration corresponding to the n-th degree determined in step S204 or step S208 (step S301). For example, when a determination is made that the second inputted pitch is the second degree, a type of the first illustration corresponding to the second degree is selected. In doing so, even where the pitch of F (fa) is inputted when the tonality of the musical composition is Eb, the same type of the first illustration is selected as in the case where the pitch of D (re) is inputted when the tonality of the music composition is C. By doing so in this manner, it can be indicated whether the inputted pitch is inputted in the n-th degree in the determined tonality, and thus, the user can intuitively understand whether the inputted pitch is the n-th degree even when the key changes. Next, the illustration selector 112 selects the second illustration corresponding to the chord type determined in step S205 or step S209 (step S302). The illustration selector 112 then determines the size of the illustration corresponding to the velocity value determined by the performance determiner 111 among the sizes of the illustrations illustrated in FIG. 5A, FIG. 5B, and FIG. 5C (step S303). Next, the illustration selector 112 performs image processing on the illustration in accordance with the evaluation result obtained from the evaluation performed in step S211 (step S304). In a case where the evaluation result is low, the illustration selector 112 executes image processing causing the shape of the image of the plant to become deformed as an illustration, as illustrated in FIG. 6C which is the image on the right. Next, the illustration selector 112 colors the illustration based on the scoring result of the performance (step S305). Specifically, in a case where the scoring result obtained from the scoring in step S210 does not reach a particular standard, the illustration is changed to a line drawing in which the area within the outline is uncolored as illustrated in FIG. 7A and then when the scoring result reaches the particular standard an illustration whose area within the outline is colored is selected as illustrated in FIG. 7C which is the image on the right. After this, the illustration selection processing is completed so processing returns to the image display processing illustrated in FIG. 10.

Figure 13:
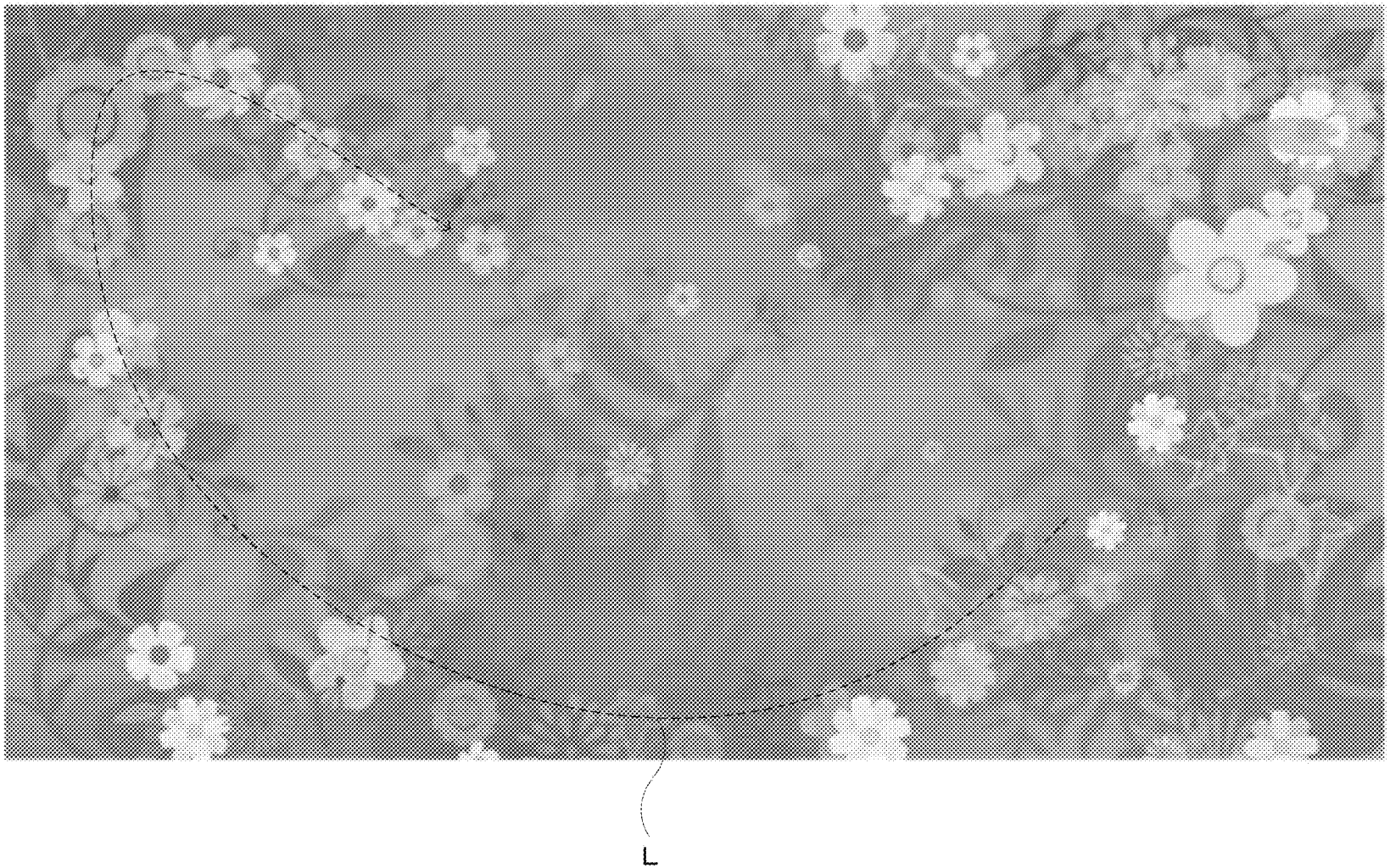
FIG. 13 is a diagram illustrating an example of an image to be displayed in real-time in accordance with a performance according to the embodiment of the present disclosure.

Next, the performance determiner 111 determines the chord progression (step S104). Next, the illustration selector 112 selects a trajectory pattern PS corresponding to the chord progression, from among the trajectory patterns illustrated in FIGS. 8A, 8B, and 8C (step S105). On the actual display 130, there are no lines indicating these trajectory patterns PS. Next, an illustration is placed within an image displayed in accordance with the selected trajectory pattern PS (step S106). At this time, the illustration selector 112 adds a new illustration along the trajectory pattern PS in addition to the illustration that is already displayed such that the newly-added illustration is displayed in real-time. An illustration that is selected based on performance data that is older than a predetermined time is not illustrated. Next, the image information outputter 113 generates first image information indicating where the first illustration and the second illustration are placed and outputs the first image information from the output interface 131 and displays the first image information on the display 130 (step S107). FIG. 13 illustrates an example in which an image is displayed in real-time on the display 130. This image is an example of an image of a flowers and plants that are displayed in accordance with a trajectory pattern PS displayed in FIG. 8A in a case where the chord progression of Canon is performed. The illustrations of the flowers and plants are added in real-time to conform with the performance along a dashed line L.

Next, a determination is made as to whether or not the performance is completed (step S108), and when a determination is made that the performance is not completed (NO in step S108), processing returns to step S101 and steps S101 to S108 are repeated. In doing so, the illustrations are added to the image in real-time based on the inputted performance data during the performance using the electronic musical instrument 200.

Figure 14:
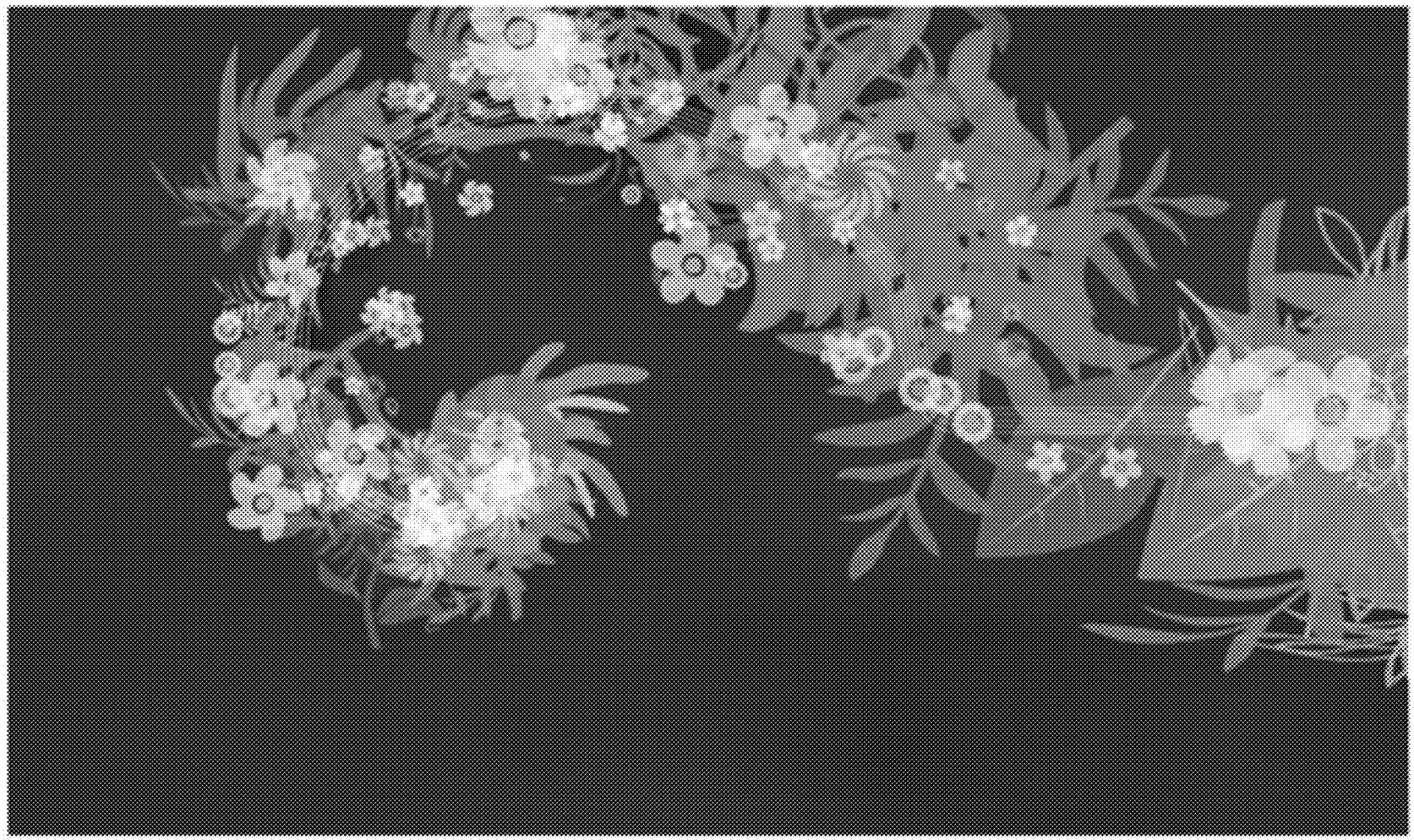
FIG. 14 is a diagram illustrating an example of a display image to be displayed after the performance according to the embodiment of the present disclosure.
Figure 15:
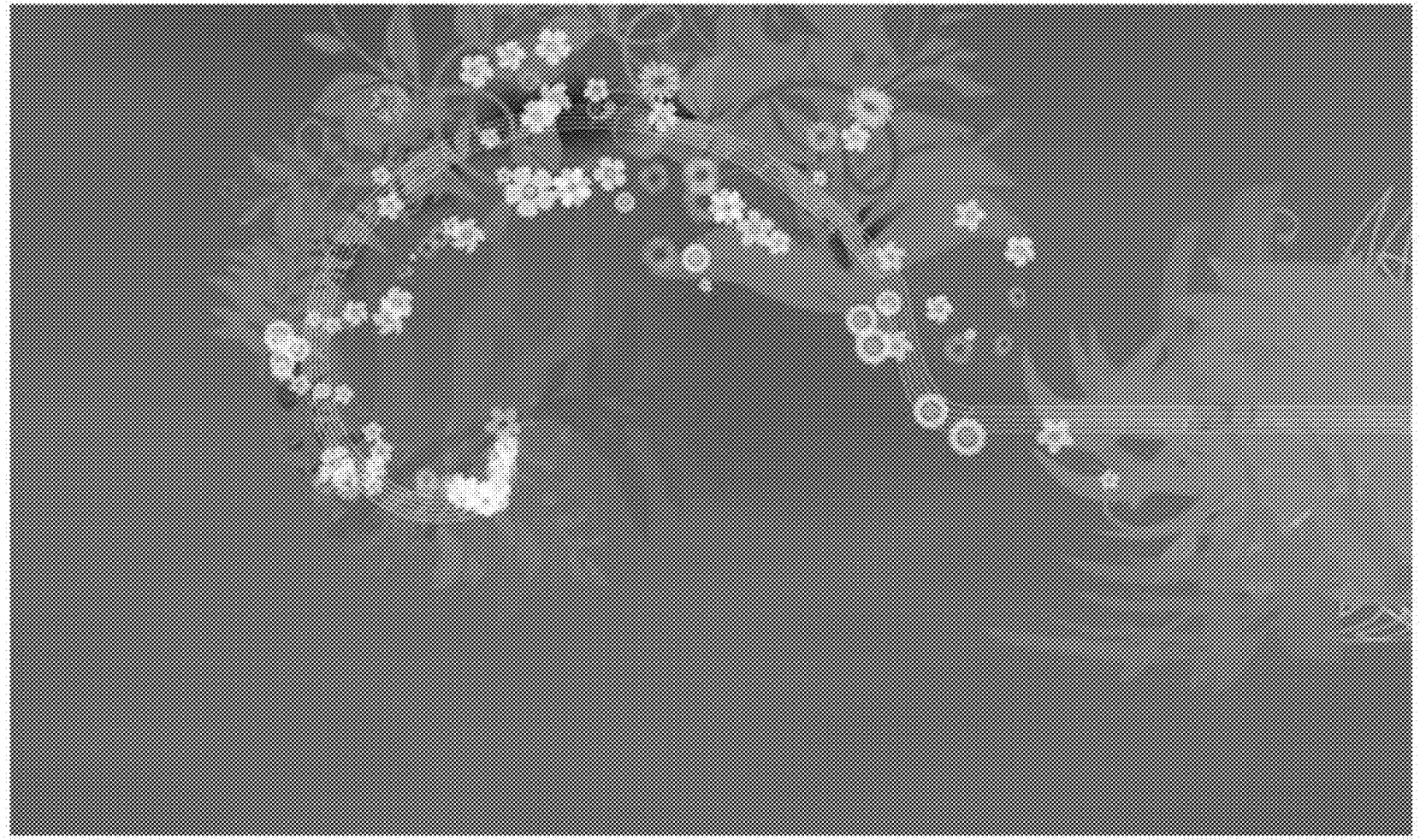
FIG. 15 is a diagram illustrating another example of a display image to be displayed after the performance according to the embodiment of the present disclosure.

When a determination is made that the performance is completed (YES in step S108), the placement positions of the first and second illustrations are reconfigured (step S109). Next, the image information outputter 113 generates second image information in which the placement positions of the first and second illustrations are reconfigured, outputs the generated second image information from the output interface 131, and displays the outputted second image information on the display 130 (step S110). In a case where the user specified the chord, the image in which the first illustration (flower) corresponding to the pitch is placed and the second illustration (plant) corresponding to the chord progression is placed, as illustrated in FIG. 14, is displayed on the display 130. Even in a case where the user only plays the melody of the same musical composition, since the chord type is determined based on the pitch data included in the performance data and the tonality of the musical composition, the image in which the first illustration corresponding to the pitch is placed and the second image corresponding to the chord type is placed, as illustrated in FIG. 15, is displayed on the display 130. When a predetermined period of time since receiving the performance data elapses or a performance completion instruction is received, the second image illustrated in FIG. 14 and FIG. 15 is displayed instead of the displaying the first image illustrated in FIG. 13.

As described above, the information processing device 100 according to the present embodiment can display an image that visually expresses a musical composition performed using the electronic musical instrument 200 in real-time. Specifically, the information processing device 100 receives an input of performance data containing the pitch data sent from the electronic musical instrument 200, determines the tonality of the musical composition and the chord function (interval indicating the n-th degree), and displays an image containing the first illustration. Even in a case where the melody is inputted, since the tonality of the musical composition is determined, an illustration corresponding to the interval (n-th degree) from the tonic (first degree) in the tonality of the musical composition can be displayed instead of displaying an illustration that merely corresponds to the pitch name. As such, the user who viewed the image can visually perceive that the inputted pitch is the n-th degree which is this is excellent for learning how to play music in that it enables the user to have an intuitive understanding. Also, even in a case where only melody in single notes is inputted and a chord that matches the melody is not specified, the information processing device 100 determines the chord by temporarily determining the tonality from only one pitch data included in one performance data and displays the illustration corresponding to the chord. Therefore, the illustration corresponding to the chord, not specified from the melody of single notes, is displayed. Thus, even if a beginner who is not yet able to play a chord is performing, the second illustration is displayed in the same manner as when a chord is specified. Even when the user is performing a simple operation of playing only a melody, since the second illustration is displayed this is advantageous for senior citizens or as a tool for communication. Even if only the melody is played for the same musical composition, since the second illustration corresponding to the chord is displayed this motivates the user to practice more and enables beginners to advanced players to visualize their performance free of stress.

That is, in a case where the user only specifies the piano keys corresponding to the melody and does not specify the piano keys corresponding to the chord in a comparison example in which that of the present disclosure is not applied, the display 130 does not display the second illustration corresponding to the chord but rather merely displays the first illustration in accordance with the melody. Therefore, the number of illustrations displayed on the display 130 is low in comparison to the case where that of the present disclosure is applied, and thus the user is imparted with a sense of loneliness. If the present disclosure is applied, the first illustration corresponding to the melody and the second illustration corresponding to the chord are both displayed on the display 130. Therefore, the number of illustrations displayed on the display 130 is high in comparison to the comparison example, and thus the user is not imparted with a sense of loneliness. Also, an image that matches the performance is displayed even if a substantial portion of the musical composition is performed playing only the melody. The performance is evaluated based on the timings at which each of the piano keys 220 are operated by the user and image processing is performed on the illustrations in accordance with the evaluation result. Also, the performance is scored based on the velocity values and the illustrations are colored in accordance with the scoring result. In doing so, the performance can be visually perceived regardless of whether the performance is good or lackluster. Also, the illustrations are displayed in a trajectory pattern in accordance with the chord progression. Thus, the chord progression can be visually perceived.

The present disclosure is not limited to the embodiment described above and various modifications can be made.

In the above embodiment, although the performance data is described as having a data structure that is compliant with the MIDI standard, the performance data is not particularly restricted as long as the performance data contains the pitch data. For example, the performance data may be audio information in which the performance is recorded. In such a case the pitch data can be extracted from the audio information and visually expressed by the information processing device 100 by displaying the pitch data as an image.

Also, in the above embodiment, although the information processing device 100 is described as having a built-in display 130, it is sufficient as long as the information processing device 100 has an output interface 131 that outputs image information. In such a case, the image information is outputted from the information processing device 100 to an external display device via the output interface 131. If a large display or video projector is used as the external display device, the image can be shown to a large audience. Alternatively, the information processing device 100 may be built into the electronic musical instrument 200. In such a case, the display 130 may also be built into the electronic musical instrument 200 and the image information may be outputted to an external display device via the output interface 131.

Also, in the above embodiment, although the size of the illustration is selected based on the velocity value, as long as the size of the illustration is selected in accordance with the received performance data, the information processing device 100 may select the size of the illustration based on one or a combination of two or more of the difference between the downbeats and upbeats, the pitch, beats per minute (BPM), number of chords inputted at the same time, and velocity values. In such a case, bass is depicted by large illustrations (correlation between the wavelength and the size of the illustration), large illustrations are displayed when the accent is great (correlation between the sound volume and the size of the illustration), large illustrations are displayed when the tempo is slow (correlation between BPM and the size of the illustration), the illustrations are displayed more largely by chords than by single notes (correlation between the number of notes and the size of the illustration), and large illustrations are displayed for high velocities (correlation between the volume and the size of the illustration).

In the above embodiment, the performance determiner 111 is described as performing an evaluation based on the timings at which the piano keys 220 were operated by the user. The performance determiner 111 may evaluate a performance by scoring the performance in terms of whether that which is expressed is, for example, sad or happy or heavy or light based on at least the timings, rhythm, beats, or velocities values of the performance operation elements operated by the user obtainable from the received performance data.

Also, although the above embodiment does not describe any limitations with respect to a background color, the background color may be determined based on the tonality of the musical composition. In such a case, a background color table containing tonality of a musical composition in association with background colors is stored in the ROM 160. The background color table is set in advance such that a specific color is associated with each tonality of a musical composition based on the synesthesia between sounds and colors as advocated, for example, by Alexander Scriabin. That is, each tonality of a musical composition is associated with a specific background color and saved. For example, red is the color that is associated with C major. Alternatively, brown is the color that is associated with C major. The specific colors that are associated with each minor key are darker than the colors that are associated with each major key. That is, the controller 110 determines the background color corresponding to the determined tonality. The image having a background color corresponding to the tonality imparts the viewer of this image with a sensation that is similar to the sensation a person who listened to the musical composition is imparted with. The image information outputter 113 determines the background color based on the tonality of the musical composition determined by the performance determiner 111, refers to the background color table, in which specific background colors and tonalities of a musical composition are associated with each other, stored in the ROM 160, and outputs the image information containing the background color corresponding to the tonality of the musical composition.

Also, in the above embodiment, the performance determiner 111 is described as scoring a performance based on velocity values. The performance determiner 111 may instead evaluate the performance based on at least the timings or the velocity values of the performance operation elements operated by the user obtainable from the received performance data.

Also, in the above embodiment, the electronic musical instrument 200 is described as having an electronic keyboard musical instrument such as an electronic piano. The electronic musical instrument 200 may be a musical instrument including a string instrument such as a guitar or may be woodwind instrument such as a flute as long as the electronic musical instrument 200 can output the performance data containing the pitch data to the information processing device 100. The acoustic pitch of an acoustic guitar may be converted into performance data containing pitch data and the converted performance data may be outputted to the information processing device 100.

Also, in the above embodiment, the illustration selector 112 is described as selecting a type of the first illustration from a first illustration group including flower illustrations and a type of the second illustration from a second illustration group including plant illustrations. The first illustration group and the second illustration group may have illustrations other than flowers and plants. For example, the first illustration group and the second illustration group may include people, animals such as dogs and cats, bugs such as butterflies and dragonflies, forms of transportation such as cars and bicycles, musical instruments such as pianos and violins, and or characters of animated cartoons.

Also, in the above embodiment, the CPU of the controller 110 is described as performing control operations. However, control operations are not limited to software control by the CPU. Part or all of the control operations may be realized using hardware components such as dedicated logic circuits.

Also, in the foregoing description, an example is described in which the ROM 160 that is nonvolatile memory such as flash memory, is used as the computer-readable medium on which the programs related to the processing of the present disclosure are stored. However, the computer-readable medium is not limited thereto, and a portable recording medium such as a hard disk drive (HDD), a compact disc read-only memory (CD-ROM), or a digital versatile disc (DVD) may be used. Additionally, a carrier wave may be used in the present disclosure as the medium to provide, over a communication line, the data of the program of the present disclosure.

In addition, the specific details such as the configurations, the control procedures, and the display examples described in the embodiments may be appropriately modified without departing from the scope of the present disclosure.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A method implemented by a processor, comprising:

receiving performance data including pitch data;

determining, based on the pitch data that is included in the received performance data, a key among a plurality of keys including a major key or a minor key;

selecting, based on (i) pitch data of a highest pitch among a plurality of the pitch data included in a plurality of the received performance data and (ii) the determined key, a first-type image from among a plurality of first-type images;

determining at least one of a chord detected as a chord specified by a user based on the plurality of the received performance data or a chord determined based on the determined key;

selecting, based on the determined chord, a second-type image from among a plurality of second-type images different from the first-type images; and displaying the selected first-type image and the selected second-type image on a display.

2. The method according to claim 1, further comprising:

detecting, based on the plurality of the received performance data, whether there is a chord specified by a user, and determining a chord based on the determined key even when specification of a chord by the user is not detected.

3. The method according to claim 1, wherein each of the first-type images is associated with chord functions with different intervals in the determined key.

4. The method according to claim 1, further comprising:

scoring a performance based on the received performance data, and displaying, when a result of the scoring does not reach a particular standard, an image in a form different from that of the selected first-type image.

5. The method according to claim 4, wherein the scoring is performed based on timings at which performance operation elements are operated, and correct data for determining whether performance data to be received is correct or not correct is not stored in a memory.

6. A method implemented by a processor, comprising:

receiving performance data including pitch data;

determining, based on the pitch data that is included in the received performance data, a key among a plurality of keys including a major key or a minor key;

determining, based on the determined key and pitch data of a highest pitch among the pitch data included in the received performance data, a chord function;

selecting, based on the determined chord function, a first-type image from among a plurality of first-type images, each of the first-type images being associated with chord functions with different intervals in the determined key; and displaying the selected first-type image on a display.

7. An electronic device comprising:

a display device; and a processor, wherein the processor:

receives performance data including pitch data, determines, based on the pitch data that is included in the received performance data, a key among a plurality of keys including a major key or a minor key, selects, based on (i) pitch data of a highest pitch among a plurality of the pitch data included in a plurality of the received performance data and (ii) the determined key, a first-type image from among a plurality of first-type images;

determines at least one of a chord detected as a chord specified by a user based on the plurality of the received performance data or a chord determined based on the determined key;

selects, based on the determined chord, a second-type image from among a plurality of second-type images different from the first-type images; and displays the selected first-type image and the selected second-type image on a display of the display device.

8. A performance data display system comprising:

an electronic musical instrument; and a display device, wherein the electronic musical instrument includes a processor that:

generates performance data including pitch data in accordance with a performance operation by a user, and outputs the generated performance data to the display device, and wherein the display device includes a processor that:

receives the performance data, determines, based on the pitch data that is included in the received performance data, a key among a plurality of keys including a major key or a minor key, selects, based on (i) pitch data of a highest pitch among a plurality of the pitch data included in a plurality of the received performance data and (ii) the determined key, a first-type image from among a plurality of first-type images, determines at least one of a chord detected as a chord specified by a user based on the plurality of the received performance data or a chord determined based on the determined key;

selects, based on the determined chord, a second-type image from among a plurality of second-type images different from the first-type images; and displays the selected first-type image and the selected second-type image on a display of the display device.

9. An electronic device comprising:

a display device; and a processor, wherein the processor:

receives performance data including pitch data, determines, based on the pitch data that is included in the received performance data, a key among a plurality of keys including a major key or a minor key, determines, based on the determined key and pitch data of a highest pitch among the pitch data included in the received performance data, a chord function, selects, based on the determined chord function, a first-type image from among a plurality of first-type images, each of the first-type images being associated with chord functions with different intervals in the determined key; and displays the selected first-type image on a display of the display device.

10. A performance data display system comprising:

an electronic musical instrument; and a display device, wherein the electronic musical instrument includes a processor that:

generates performance data including pitch data in accordance with a performance operation by a user, and outputs the generated performance data to the display device, and wherein the display device includes a processor that:

receives the performance data, determines, based on the pitch data that is included in the received performance data, a key among a plurality of keys including a major key or a minor key, determines, based on the determined key and pitch data of a highest pitch among the pitch data included in the received performance data, a chord function, selects, based on the determined chord function, a first-type image from among a plurality of first-type images, each of the first-type images being associated with chord functions with different intervals in the determined key; and displays the selected first-type image on a display of the display device.

* * * * *